United States Patent [19]

Affüpper

[11] Patent Number: 4,493,689

[45] Date of Patent: Jan. 15, 1985

[54] PROCESS AND EQUIPMENT FOR MAKING ZIGZAG FOLDS IN LOOPS OF A CONTINUOUS FEED OF FLEXIBLE SHEETING

[76] Inventor: Hans Affüpper, Krautstrasse 55, 5600 Wuppertal 2, Fed. Rep. of Germany

[21] Appl. No.: 356,740

[22] Filed: Mar. 10, 1982

[30] Foreign Application Priority Data

Apr. 9, 1981 [DE] Fed. Rep. of Germany ..... 3114395

[51] Int. Cl.[3] ..... B65H 29/46

[52] U.S. Cl. ..... 493/415; 493/411

[58] Field of Search ..... 493/411, 413, 414, 415, 493/430, 433

[56] References Cited

U.S. PATENT DOCUMENTS

| | | | |
|---|---|---|---|
| 966,760 | 8/1910 | Mutschler | 493/415 |
| 2,009,665 | 7/1935 | Kaufmann | 493/415 |
| 2,653,812 | 9/1953 | Cohn et al. | 493/415 |
| 3,697,062 | 10/1972 | Mones et al. | 493/413 X |
| 3,790,156 | 2/1974 | Hogendyk | 493/415 X |
| 4,074,901 | 2/1978 | Cotallo | 493/413 |

*Primary Examiner*—John Sipos
*Assistant Examiner*—Steven P. Weihrouch
*Attorney, Agent, or Firm*—Jones & Askew

[57] ABSTRACT

Process for making zigzag folds in loops of a continuous feed of flexible sheeting, especially textile sheeting, so that the sheeting (9) is drawn in with a layering device (13) which moves back and forth at a right angle to the feed direction and the sheeting is folded at the outlet. The sheeting (9) is drawn in between the two corotating rolls (4) which constitute the layering apparatus (13) so that the sheeting lies against one of the rolls (4), and the rolls (4) change their direction of rotation at the two opposite points in their back and forth movement in such a way that the rolls (4) rotate toward the left when they move laterally to the right, but the rolls rotate toward the right when they move laterally toward the left, and the sheeting (9) is delivered for folding by the roll (4) which is in the rear in the direction of lateral movement.

16 Claims, 8 Drawing Figures

FIG. 4
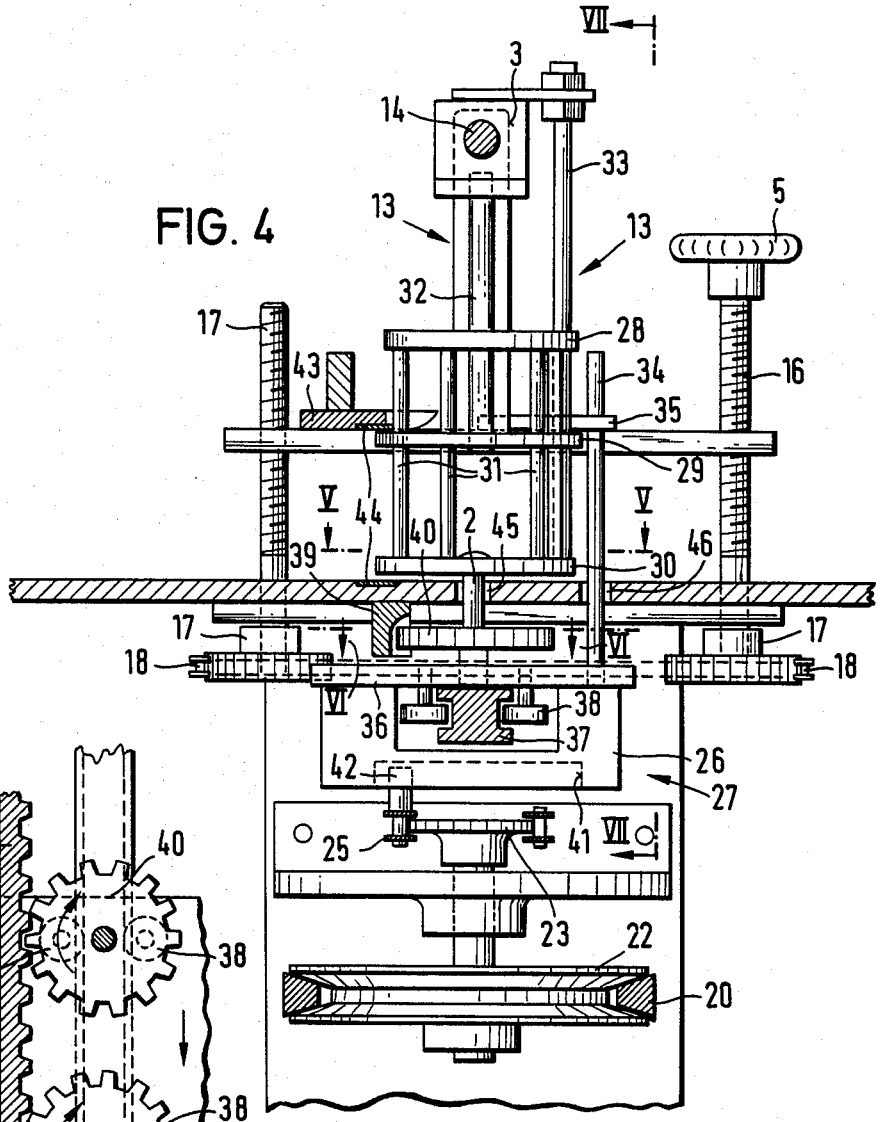
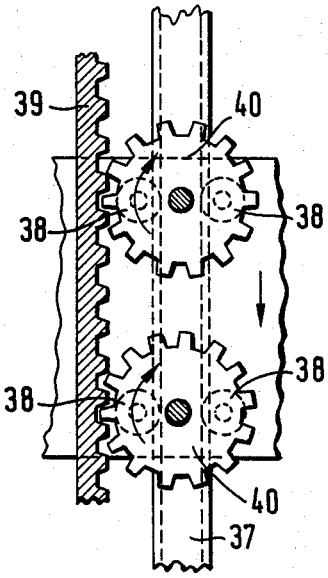
FIG. 6
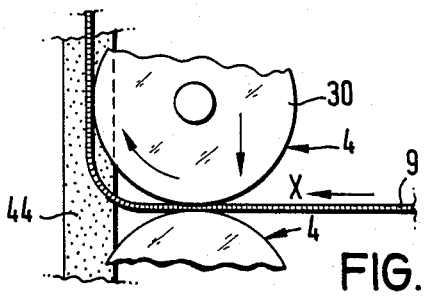
FIG. 5

PROCESS AND EQUIPMENT FOR MAKING ZIGZAG FOLDS IN LOOPS OF A CONTINUOUS FEED OF FLEXIBLE SHEETING

The present invention concerns a process of making zigzag folds in loops of a continuous feed of flexible sheeting, especially textile sheeting, so the incoming sheeting is drawn in with a layering device which moves back and forth at a right angle to feed direction and the sheeting is folded at the outlet. In addition, this invention also concerns equipment for carrying out this process.

Such a process and corresponding equipment are already known from German Pat. No. 1,802,889, where the incoming sheeting is wrapped by means of a layering device around two parallel winding pins positioned at some distance from each other. These winding pins are retracted axially out of the region of the path of movement as the layering device moves outward toward them, and after the layering device has passed the winding pin, the winding pins return to their winding position in the outward movement. In addition to the back and forth movement of the layering device, there is also a relative movement between the winding pins and the layering device at a right angle to the back and forth movement, so that the winding pins retain the last loop and push the previously completed loops forward. The winding pins on the left and right sides constitute a disadvantage of this known device, because their movement must be controlled accurately so that the movement of the sheeting will describe a figure eight. This requires a complex mechanical system which is subject to considerable wear. In addition, when the width of the sheeting changes, the layering device must be changed to adapt it to a new width. Furthermore, this known device is not very suitable for layering nonelastic sheeting, because such materials tend to fly out of the equipment. The layering operation must therefore be interrupted frequently and the sheeting can be damaged by the pins as it flies out. In addition, the quality of the layering is not optimal with regard to the regularity of the folded layers.

The present invention is based on the task of avoiding the disadvantages described above and improving a process and equipment of the type described initially in such a way that the quality of the resulting layering is uniform, and expensive and sensitive control facilities are unnecessary, while at the same time permitting adaptation to different sheeting widths without changing the layering equipment.

This is achieved according to the present invention by having the sheeting drawn in between two corotating rolls which constitute a layering device, so that the sheeting lies against one of the rolls, and the rolls change their direction of rotation at the two opposing points of reversal in the back and forth movement, so that the rotational direction of the rolls is toward the left when they are executing a lateral movement to the right, and the rotational direction of the rolls is toward the right when they are executing a lateral movement to the left, and the sheeting is discharged for folding by whichever roll is at the rear in the direction of lateral movement. With the process according to this invention, the previously known winding pins can be eliminated entirely, and it is no longer necessary for the sheeting to describe a figure eight in its movement, but now it merely moves back and forth in one plane, so this completely eliminates the necessity of expensive control equipment. Furthermore, it is advantageous according to this invention if the sheeting is braked from the top and from below before folding. This measure improves the uniformity of the resulting folds.

Advantageous versions of this invention are described in the subclaims, especially equipment that is suitable for carrying out the process according to this invention. This equipment is now explained on the basis of the practical examples shown in the accompanying diagrams.

FIG. 4 shows a section along line IV—IV in FIG. 3.

FIG. 5 shows a view according to line V–V in FIG. 4.

FIG. 6 shows a view according to the line VI—VI in FIG. 4.

Figure 1:
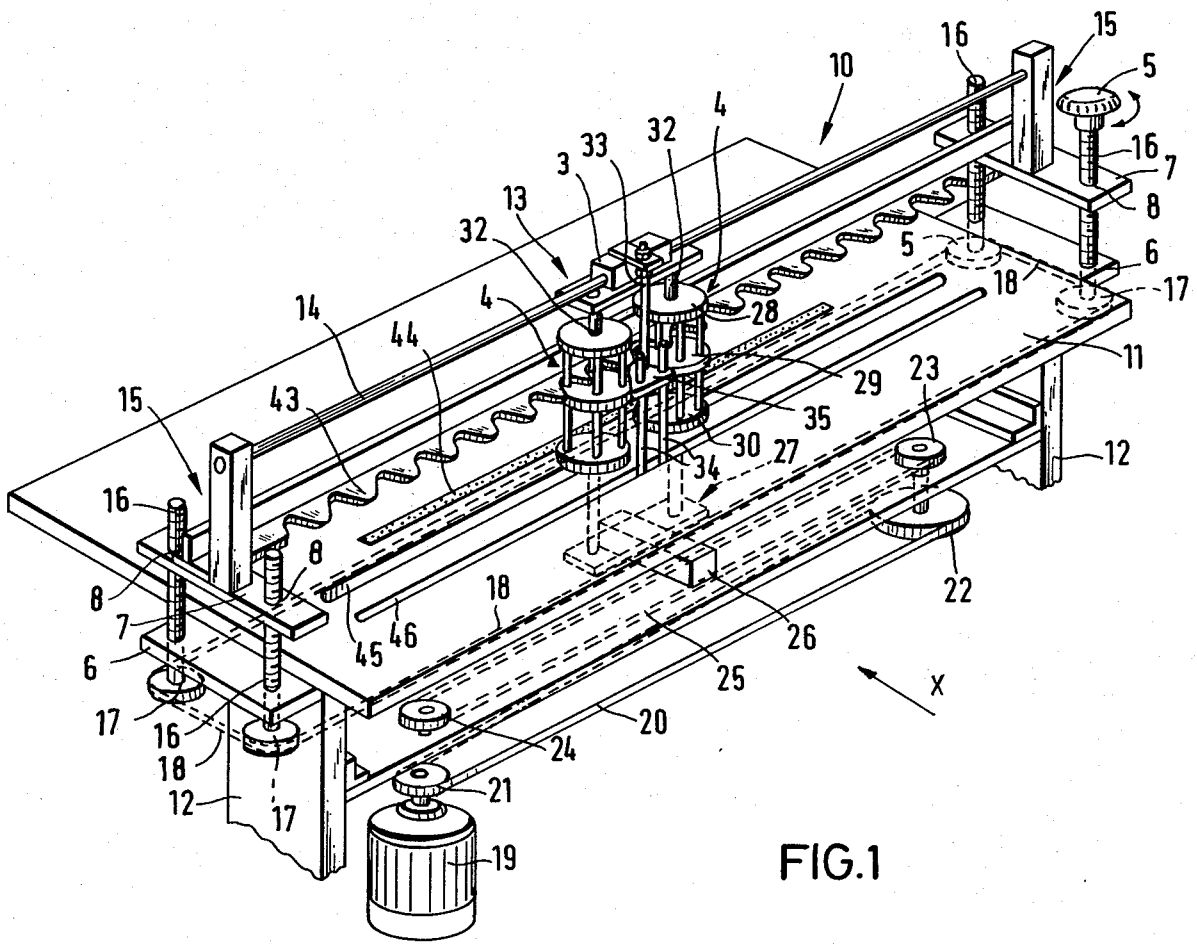
FIG. 1 shows a partial view in perspective of a layering device according to this invention.

As FIG. 1 shows, a machine 10 for layering sheeting according to this invention consists of a table plate 1 which serves as the support. The table plate 11 is attached to a stand or frame 12. A layering carriage 13 (see FIG. 2 and 3) is positioned above table plate 11, so that the carriage can move laterally back and forth (see arrow Y in FIG. 3) at a right angle to the feed direction X of sheeting 9. Layering carriage 13 is guided in a guide rod 14 above table plate 11 in accordance with its intended lateral movement, which takes place only in one plane (at a right angle to the feed direction of sheeting 9). Both ends of guide rod 14 are attached to frames 15 which can be raised and lowered. Each frame 15 is on a plate 7 with threaded holes 8 through which adjusting spindles 16 pass. Adjusting spindles 16 can rotate in bearing plates 6 which are attached to frame 12. Adjusting spindles 16 have a drive wheel at the lower end (chain wheel 17 in the present example) so that the spindles are driven together by means of chain 18. This permits uniform adjustment of adjusting spindles 16. The drive of the chain wheel 17 is such that the rotation of spindles 16 which this induces makes it possible to continously raise or lower plates 8 and frames 15. Chain 18 can be driven by motor or by hand, so a hand wheel 5 is attached to the upper end of one of spindles 16.

Layering carriage 13 has two parallel rolls 4 which rotate about horizontal axes. Between the two peripheral surfaces of rolls 4 there is a vertical gap for the sheeting 9 (see FIGS. 2 and 3), so that the sheeting enters the gap in the direction X indicated with the arrow. Sheeting 9 is then in a vertical (i.e., upright) position. The size of the gap between the peripheral surfaces of rolls 4 is such that sheeting 9 is carried along by means of friction on the peripheral surface of one of the two rolls 4 (see also FIG. 5). The two rolls are driven so as to be corotating, and the direction of rotation depends on the direction of movement of carriage 13.

Figure 2:
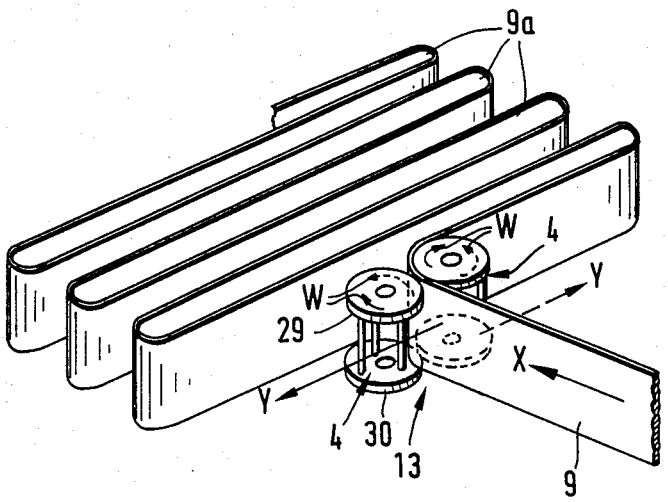
FIG. 2 shows a diagram of the principle of the layering operation by means of a process according to this invention.
Figure 3:
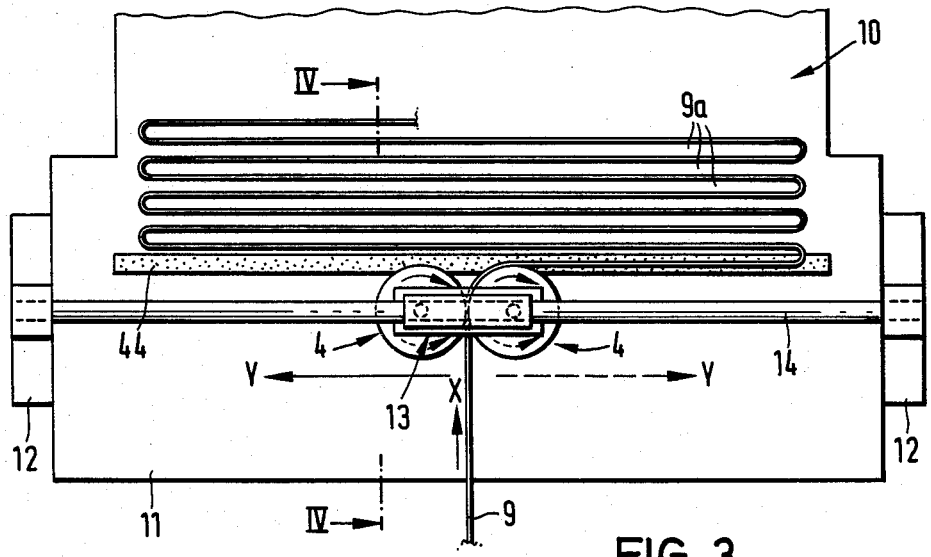
FIG. 3 shows a top view of the equipment according to FIG. 1.
Figure 7:
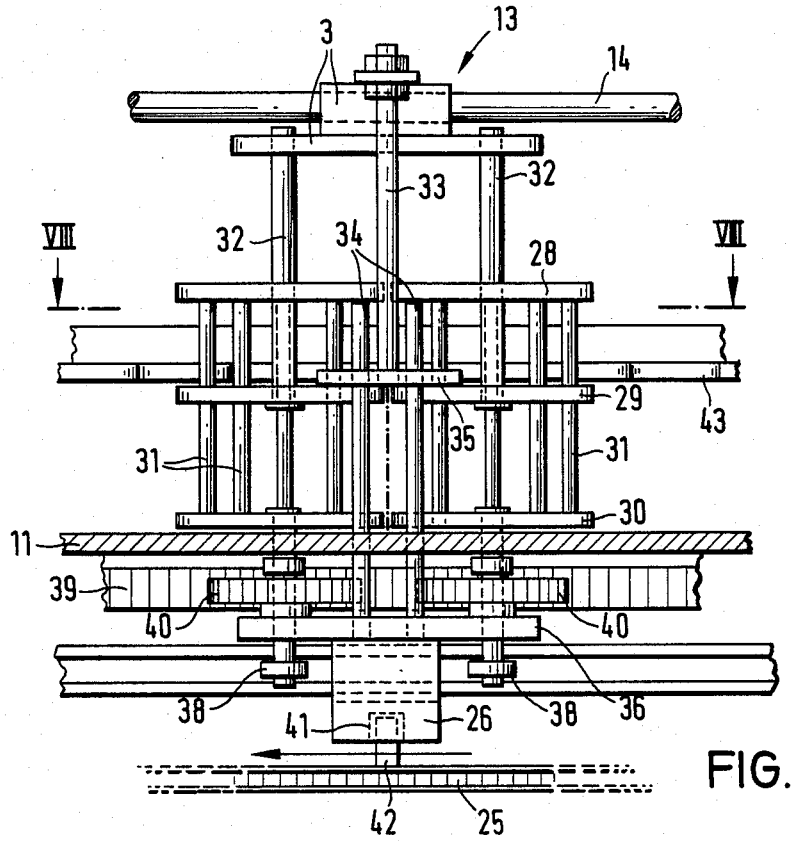
FIG. 7 shows a view according to line VII—VII in FIG. 4.

This relationship is depicted in FIGS. 2 and 3, where the direction of rotation of rolls 4 is toward the right (according to arrow W) when the carriage is moving to the left (see arrow Y) and the direction of rotation of the rolls is toward the left (see dotted arrow W) when the carriage moves to the right (dotted arrow Y). As FIGS. 3 and 5 show, sheeting 9 is drawn in by the rear roll 4 (rear with respect to the direction of movement of the carriage) against which it is held and transported further, i.e., forced out. Due to the drive described above and the lateral movement of roll 4, sheeting 9 is folded in regular loops 9*a*, as illustrated in FIGS. 2 and 3. The change in the direction of rotation W of rolls 4 takes place at the point of reversal in the lateral movement of carriage 13. By means of this invention, an absolutely uniform folding pattern is obtained with only slight deviations in the length and width of the folds so that the points of reversal in the folds are all located practically on the same line parallel to the center of the fold. In addition, there are friction pads 44 with friction surfaces which have a braking effect on the delivery of sheeting and are positioned above and below the rolls along the entire path of the lateral movement of the carriage, so that sheeting 9, as shown in FIG. 5, turns slightly upward after passing through the roll gap. The upper friction pad 44 is at the lower side of pressure pad 43. The peripheral surfaces of the rolls are matched with the friction surfaces of friction pads 44 in such a way that the front edge of the friction pad comes in contact tangentially with the surface of the roll. However, the rolls preferably reach to the center line of the friction pads. The width of the friction surfaces of the friction pads is preferably 10 to 12 mm.

The practical example shown in the figures is a preferred version in which the rolls 4 are designed so that the width of their peripheral surface is variable. This is expedient in adapting them to different sheeting widths. This is accomplished by designing rolls 4 in the form of so-called rod rolls which consist of a fixed lower disc 30 which has preferably 5 vertical rods 31 in a stationary mounting at equal intervals along the periphery of disc 30 and offset slightly toward the inside. The midpoints of the rods which have a circular cross section are all located on a concentric circular disc 30. Above fixed disc 30 there are two other discs 28 and 29 of the same size on rods 31. Of these discs, middle disc 29 is mounted on rods 31 so that it can move up and down. The three discs 28, 29 and 30 are thus positioned coaxially with respect to each other. The distance between discs 28 and 29 cannot be varied, and a rod 32 passes through a hole in the center of disc 28 and is attached to middle disc 29. The upper end of rod 32 is attached to a guide element 3 of layering carriage 13, so that guide element 3 can be moved on guide rod 14 because it has guide bushes, for example, through which guide rod 14 passes. Disc 29 is raised or lowered with respect to disc 30 as adjusting spindles 16 push the guide rod up or down, as described initially, so that at the same time the fixed connection of guide rod 14 with disc 29 by means of rod 32 causes disc 29 to be raised or lowered with respect to disc 30. The peripheral surfaces of discs 29 and 30 represent the abutment or entrainment surfaces for sheeting 9 (see FIG. 2) so this makes it possible to adapt the effective entrainment surface to the given sheeting width and to make this adjustment simultaneously for both rolls 4.

Figure 8:
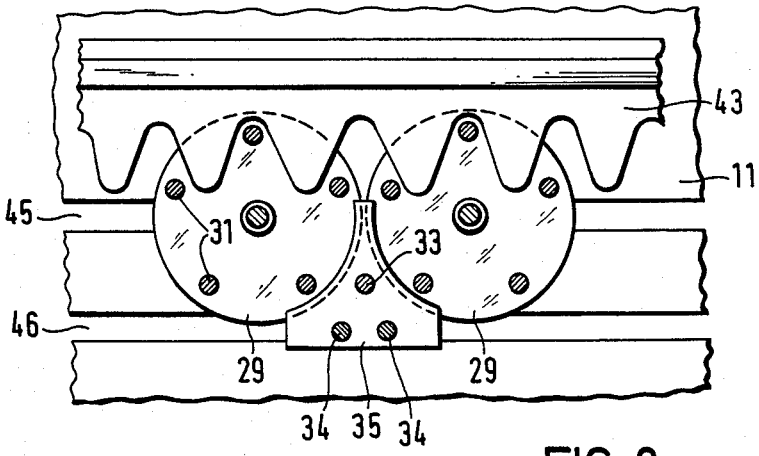
FIG. 8 shows a view according to line VIII—VIII in FIG. 7.

Immediately above middle disc 29 there is a limiting plate 35 which closes the gap between the two rolls 4 at the top and prevents the sheeting from slipping out. The height of this limiting plate 35 can be adjusted together with disc 29, so it is attached to the lower end of a vertical rod 33, the upper end of which is connected to guide element 3, so that limiting plate 35 executes the same up and down movement as disc 29. Two parallel vertical guide rods 34 are positioned directly in front of the gaps formed by rolls 4, and sheeting 9 enters the roll gap between these guide rods 34. Guide rods 34 pass through limiting plate 35, which can thus slide on rods 34. As shown in FIG. 8 in particular, limiting plate 35 is designed so that its sides are concave in accordance with the circular path described by rods 31 in the rotation of rolls 4 and is slightly longer than the radius of rolls 4 so that the roll gap which widens toward the outside in accordance with the peripheral surface of rolls 4 is covered from above along more than half its length.

Since rolls 4 are designed as rod rolls, the upper pressure pad 43 is toothed. The number of teeth depends on the number of rods in the rod roll and their peripheral velocity. The teeth on pressure pad 43 project to just before the center of the roll and their edges are preferably rounded and narrowed to a point at the lower edge. The teeth are designed so that the rod rolls have some tolerance in running in them. Since the ends of pressure pad 43 are attached to plate 7, pressure pad 43 is raised and lowered together with disc 29. As FIGS. 1 and 4 show, pressure pad 43 is directly above disc 29.

The drive for layering carriage 13 for its back and forth movement at a right angle to the feed direction X of the sheeting is provided by a chain drive consisting of chain wheels 23 and 24 and chain 25. Of chain wheels 23 and 24, wheel 23 is driven by a belt drive from pulleys 21 and 22 and V-belt 20. The pulley 21 is on the drive shaft of the motor 19, and the pulley 22 is connected to chain wheel 23 by a shaft (see FIGS. 1 and 4). Chain 25 is connected to a pusher dog 26 by means of a retaining bolt 42 which slides back and forth.

I claim:

1. Apparatus for making zig-zag folds in loops of continuous feed of flexible sheeting such as textile sheeting or the like, comprising:

layering means operative to receive a feed of the flexible sheeting and means for moving said layering means back and forth along a path perpendicular to the direction of feed;

said layering means comprising a pair of rolls rotating in the same direction, and having a sheet feed slot between said rolls;

means for mounting said rolls in spaced relationship to each other, with said space being wider than the thickness of the sheeting so that the sheeting lies against only the rearward roll, seen in the direction of movement of the layering means, as the layering means moves back and forth;

means operative to co-rotate both of said rolls in the same first direction as the layering means moves in one direction along said path, and operative to co-rotate both of said rolls in the same second direction as the layering means moves in the other direction along said path; and said directions of rotation moving the circumference of the rearward roll in a direction opposite to the movement of the layering means along said path, so that the rearward roll feeds the sheeting in zig-zag folds as the layering means moves back and forth.

2. The apparatus as in claim 1, further comprising braking means disposed to engage the longitudinal edges of the sheeting moving past said rear roll before the sheeting is folded, thereby supporting the sheeting for the resulting folds.

3. The apparatus as in claim 1, further comprising a table surface above which said layering means is supported in predetermined relation, so that said table surface supports a longitudinal edge of said zig-zag folds of sheeting.

4. The apparatus as in claim 3, wherein said means operative to co-rotate said rolls comprises:

a rack gear mounted running parallel to the path of movement of said layering means; and pinion means engaging said rack gear and connected to drive said pair of co-rotating rolls, so that both said rolls co-rotate in the same selected first direction or second direction as said layering means moves in one direction or the other direction along said path.

5. The apparatus as in claim 3, further comprising means selectably operative to vary the axial width of said rolls, thereby accommodating sheeting of various widths.

6. The apparatus as in claim 5, wherein said rolls comprise at least two circular discs of substantially identical size arranged coaxially one above the other; and means mounting siad discs for relative axial movement therebetween, so that the axial width between discs is adjustable.

7. The apparatus as in claim 6, wherein said discs are connected by a plurality of rods which are spaced evenly on a circle inside the circumferences of the discs.

8. The apparatus as in claim 7, wherein the outer disc relative to said table surface means is selectably axially shiftable along said rods.

9. The apparatus as in claim 8, wherein:

each said roll comprises a third disc positioned coaxially beyond said outer disc and holds the outer ends of said rods, so that said outer disc is axially shiftable relative to the other said discs.

10. The apparatus as in claim 3, further comprising:

a pressure pad supported above said table surface in position to receive the sheeting that exits said sheet feed slot;

said pressure pad extends parallel to the path of movement of said layering means and is at least substantially coextensive with the length of said path; and said pressure pad is disposed to engage and brake a longitudinal edge of the sheeting that exits said sheet feed slot.

11. The apparatus as in claim 10, wherein:

said rolls comprise at least two circular discs of substantially identical size arranged coaxially one above the other;

said discs are connected by a plurality of rods which are spaced evenly on a circle inside the circumference of the discs;

said pressure pad is toothed at a pitch depending on the number of said rods and the peripheral velocity of the rods; and said teeth extend approximately to the center of said rolls, so that the sheeting is fed by said rearward roll into braking engagement with said pressure pad as said layering means moves back and forth.

12. The apparatus as in claim 11, further comprising a limiting plate mounted immediately above said rolls alongside said sheet feed slot, so as to cover the edge of the sheet feed slot in distal relation to said table surface.

13. The apparatus as in claim 12, wherein said limiting plate has side edges which are complementary to the outer diameter of the circular path of said rods.

14. The apparatus as in claim 11, wherein:

said pressure pad is disposed immediately above the circular disc that is distal relative to said table surface; and further comprising height adjusting means operatively engaging said pressure pad and said distal disc so as to concurrently adjust the spacing between the table surface, and the pressure pad and distal disc, whereby the distal disc and the pressure pad maintain the same position relative to each other irrespective of adjustments in spacing relative to the table surface.

15. The apparatus as in claim 10, further comprising:

frictional pads disposed one above the other in mutually confronting relation on said table surface and on said pressure pad; and said frictional pads having front edges which are overlapped by the diameter of said rolls, so that the longitudinal edges of the sheeting are fed into frictional engagement with said frictional pads as said layering means moves back and forth.

16. The apparatus as in claim 3 wherein said layering means is driven for reciprocating movement back and forth along said path by a chain drive below said table surface.

* * * * *